US005625984A

United States Patent [19]

Chapman et al.

[11] Patent Number: 5,625,984

[45] Date of Patent: May 6, 1997

[54] GROUND ANCHOR

[76] Inventors: James P. Chapman, 16026 Pool Canyon Rd., Austin, Tex. 78734; Paul N. McKim, 5405 Merrywing Cir., Austin, Tex. 78730

[21] Appl. No.: 399,765

[22] Filed: Mar. 7, 1995

[51] Int. Cl.[6] ..... E02D 5/80

[52] U.S. Cl. ..... 52/166; 52/163; 405/259.1

[58] Field of Search ..... 52/166, 162, 163, 52/153, 154, 155, 165; 405/238, 248, 259.1

[56] References Cited

U.S. PATENT DOCUMENTS

| | | | |
|---|---|---|---|
| 1,376,854 | 5/1921 | Bearse | 52/155 |
| 2,784,815 | 3/1957 | Larson | 52/155 |
| 2,841,256 | 7/1958 | Clevett, Jr. | 52/166 |
| 3,888,057 | 6/1975 | Zubke . | |
| 3,969,854 | 7/1976 | Deike . | |
| 4,023,314 | 5/1977 | Tanner | 52/162 |
| 4,096,673 | 6/1978 | Deike . | |
| 4,300,857 | 11/1981 | Santamaria | 52/162 |
| 4,611,446 | 9/1986 | Beavers et al. . | |
| 4,688,360 | 8/1987 | Luong et al. . | |
| 4,727,693 | 3/1988 | Rockenfeller et al. . | |
| 4,738,063 | 4/1988 | Alsop . | |
| 4,802,317 | 2/1989 | Chandler . | |
| 5,031,370 | 7/1991 | Jewett . | |
| 5,050,355 | 9/1991 | Pildysh . | |
| 5,171,108 | 12/1992 | Hugron . | |
| 5,175,966 | 1/1993 | Remke et al. | 52/166 |

FOREIGN PATENT DOCUMENTS

| | | |
|---|---|---|
| 577784 | 5/1982 | Japan . |

*Primary Examiner*—Michael Safavi
*Attorney, Agent, or Firm*—Baker & Botts, L.L.P.

[57] ABSTRACT

An anchor for anchoring a structure to the ground includes an anchor shank (10) having a connection point (18) at which a connecting member is coupled to the anchor shank (10). An anchor body (12) is pivotally connected to the anchor shank (10) at a point (14) remote from the connection point (18).

15 Claims, 5 Drawing Sheets

GROUND ANCHOR

TECHNICAL FIELD OF THE INVENTION

This invention relates generally to anchoring systems, and more particularly to a ground anchor.

BACKGROUND OF THE INVENTION

Ground anchors are used in a wide variety of applications, both on dry land and under water, for example in anchoring antennae or floating structures, such as docks.

Ground anchors are generally driven lengthwise into the ground (either directly or through pre-drilled holes) and then pulled upward when the desired depth has been reached. The pulling action results in tilting the anchor into a transverse position for the anchoring function. The tilting occurs about a pivot point. With prior art anchors, a connection feature (such as a socket, padeye, or shackle, among others) is formed at the pivot point for coupling to a connecting rod, cable, or chain ("connecting member"). The connecting member connects the anchored structure to the anchor.

Such prior art anchors are exemplified in the following United States patents: U.S. Pat. No. 5,171,108 issued to Hugron on Dec. 15, 1992; U.S. Pat. No. 5,050,355 issued to Pildysh on Sep. 24, 1991; U.S. Pat. No. 5,031,370 issued to Jewett on Jul. 16, 1991; U.S. Pat. No. 4,802,317 issued to Chandler on Feb. 7, 1989; U.S. Pat. No. 4,738,063 issued to Alsop on Apr. 19, 1988; U.S. Pat. No. 4,727,693 issued to Rockenfeller, et al. on Mar. 1, 1988; U.S. Pat. No. 4,688,360 issued to Luong, et al. on Aug. 25, 1987; U.S. Pat. No. 4,611,446 issued to Beavers, et al. on Sep. 16, 1986; U.S. Pat. No. 4,096,673 issued to Deike on Jun. 27, 1978; U.S. Pat. No. 3,969,854 issued to Deike on Jul. 20, 1976; and U.S. Pat. No. 3,888,057 issued to Zubke on Jun. 10, 1975. These patents are herein incorporated by reference.

with prior art anchors, the bulk of material needed to form the connection feature is added to the pivot point. Because the pivot point often has a significant cross-section in and of itself, the addition of the connection feature results in an even larger cross section. Such large cross sections result in difficult insertion of anchors into the ground, and often require the drilling of holes of diameters sufficient to accommodate the cross section of the combination pivot point and the connection feature.

Furthermore, the weakest point of a ground anchor is generally at the pivot point, since this is where force is exerted between the connecting member and the anchor. Therefore, the strength of the anchor will generally be determined by the type of material and geometry of the pivot point. With prior art systems, the connecting member is attached at the pivot point, and thus the connection feature is formed at the pivot point. Such features can reduce anchor strength, since they are formed at the weakest point, unless the anchor is appropriately sized up.

Therefore, a need has arisen for a ground anchor that is relatively stronger for its size than prior art anchors, thus allowing for easier driving of the anchor into the ground. In particular, a need has arisen for a ground anchor that can be driven into narrower holes, since narrower holes can be drilled into the ground more quickly and at less cost than wider holes.

SUMMARY OF THE INVENTION

Accordingly, a ground anchor is provided herein which substantially eliminates or reduces disadvantages and problems associated with prior art ground anchors. In particular, an anchor is provided for anchoring a structure to the ground, the anchor coupled to the structure through a connecting member. The anchor includes an anchor shank having a connection point at which the connecting member is coupled to the anchor shank and an anchor body pivotally connected to the anchor shank at a point remote from the connection point. In a particular embodiment, the anchor shank includes a socket to facilitate insertion of the anchor into the ground.

In another particular embodiment, the anchor shank includes a recessed shoulder for engaging with the anchor body. With this recessed shoulder, the anchor body is locked into the anchor shank during insertion of the anchor into the ground.

In another embodiment, a hollow anchor piece is provided for coupling with a fluid (e.g., water) supply to allow jetting operations for easier insertion into the ground.

An important technical advantage of the present invention is the fact that an anchor shank is provided which couples with a connecting member. The point at which the connecting member couples with the anchor shank is remote from a pivot point at which an anchor body pivots on the anchor shank. This remote connection allows for a ground anchor which is smaller in cross section than anchors of comparable strength.

Another important technical advantage of the present invention is the fact that the anchor shank includes a socket or other receiving fitting for receiving an insertion device. The insertion device is used to drive the anchor into the ground. By disposing this insertion socket on an anchor shank, the insertion cross section of the anchor of the present invention is smaller than anchors of comparable strength.

Another important technical advantage of the present invention is the fact that a recessed shoulder may be used for locking the anchor body to the anchor shank during insertion of the anchor into the ground.

Another important technical advantage of the present invention is the fact that it can be hollowed to allow the passage of fluids for jetting operations, to allow easier insertion into the ground.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiment of the present invention and its advantages are best understood by referring to FIGS. 1 through 8 of the drawings, like numerals being used for like and corresponding parts of the various drawings.

Figure 1:
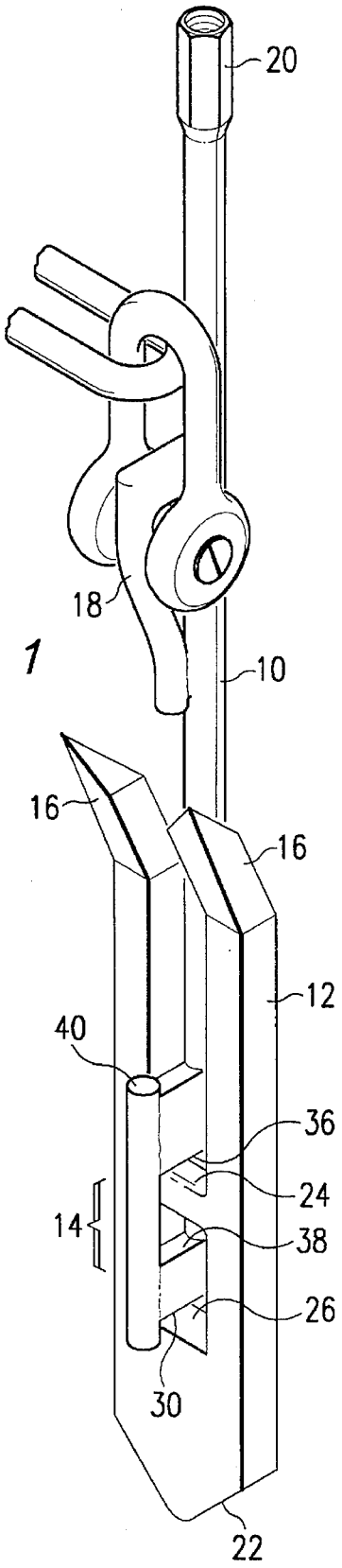
FIG. 1 illustrates a perspective view of a ground anchor according to the teachings of the present invention.

FIG. 1 illustrates a perspective view of a ground anchor according to the teachings of the present invention. The ground anchor of the present invention may be made of any suitable material, including, but not limited to, cast iron, stainless steel, or any combination of suitable materials or alloys. As shown in FIG. 1, the ground anchor of the present invention includes an anchor shank 10 pivotally connected to an anchor body 12 at pivot point 14. Anchor body 12 includes end 16. End 16 initiates, upon pulling of the anchor after it has been inserted in the ground, the pivoting of anchor body 12. In particular, end 16 engages with the ground upon the pulling operation, resulting in the pivotal action.

Also shown in FIG. 1 is padeye 18 formed on anchor shank 10 remote from pivot point 14. Padeye 18 provides a connection feature for coupling a connecting member (a chain is illustrated in the FIGUREs) to the anchor. The connecting member is used to connect the anchor to the structure to be anchored. It should be understood that any type of connecting member, such as a rod, cable, chain, or any other suitable connection member, can be used for connecting the ground anchor of the present invention with the structure to be anchored. Thus, the padeye 18 shown in FIG. 1 is exemplary only, and other types of connection features, such as screw fittings for threaded connecting rods, or any other type of connection fitting, can be used without departing from the intended scope of the present invention. It is important only that the connection feature be remote from the pivot point 14.

By providing a connection point that is remote from the pivot point 14, the present invention provides a significant advantage over prior art systems. In particular, the bulk of material required to form the connection feature (such as padeye 18) is placed remote from the pivot point 14, and therefore the cross section of the ground anchor of the present invention (for purposes of insertion) is greatly reduced over that of prior art systems. This advantage results because the pivot point of a typical ground anchor has a significant cross section in and of itself, and thus placing the connection point at the pivot point, as in prior art systems, presents an even larger cross section. With the present invention, the cross section attributable to the connection feature is placed "in line" with that of the pivot point, and is thus not added to that of the pivot point. Therefore, the anchor of the present invention can be inserted into the ground more easily, and in particular into holes of smaller diameters, than prior art systems. The ability to be inserted into holes of smaller diameters provides a significant advantage, since smaller holes can be drilled for less cost and more quickly than wider holes. The present invention provides cross sectional reductions over anchors of comparable strength on the order of fifty percent or more.

Figure 2:
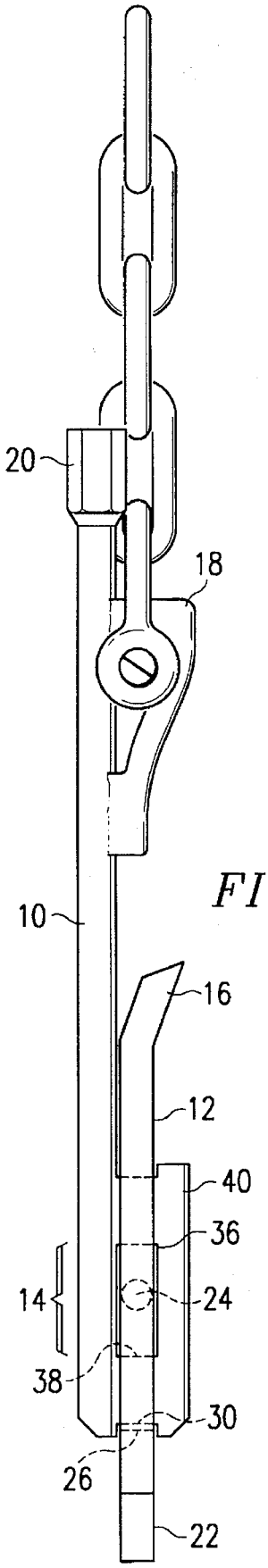
FIG. 2 illustrates a side view of a ground anchor according to the teachings of the present invention before the anchor is set.
Figure 3:
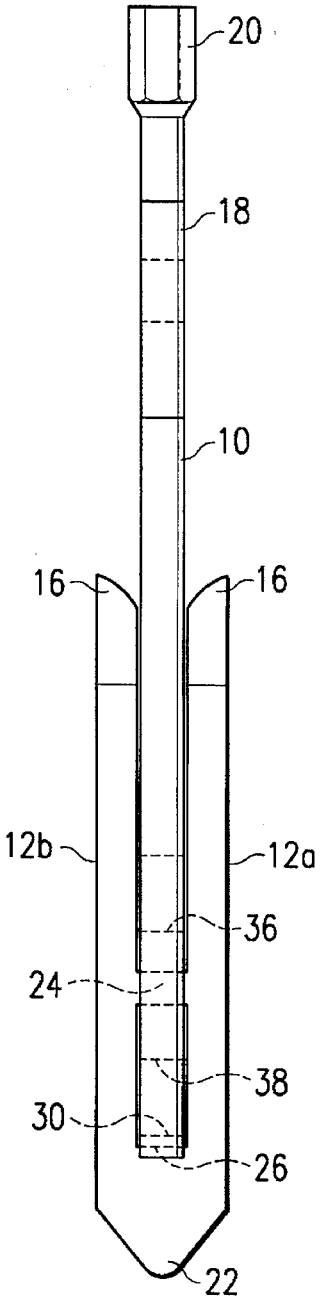
FIG. 3 illustrates a front view of a ground anchor according to the teachings of the present invention before the anchor is set.
Figure 4A:
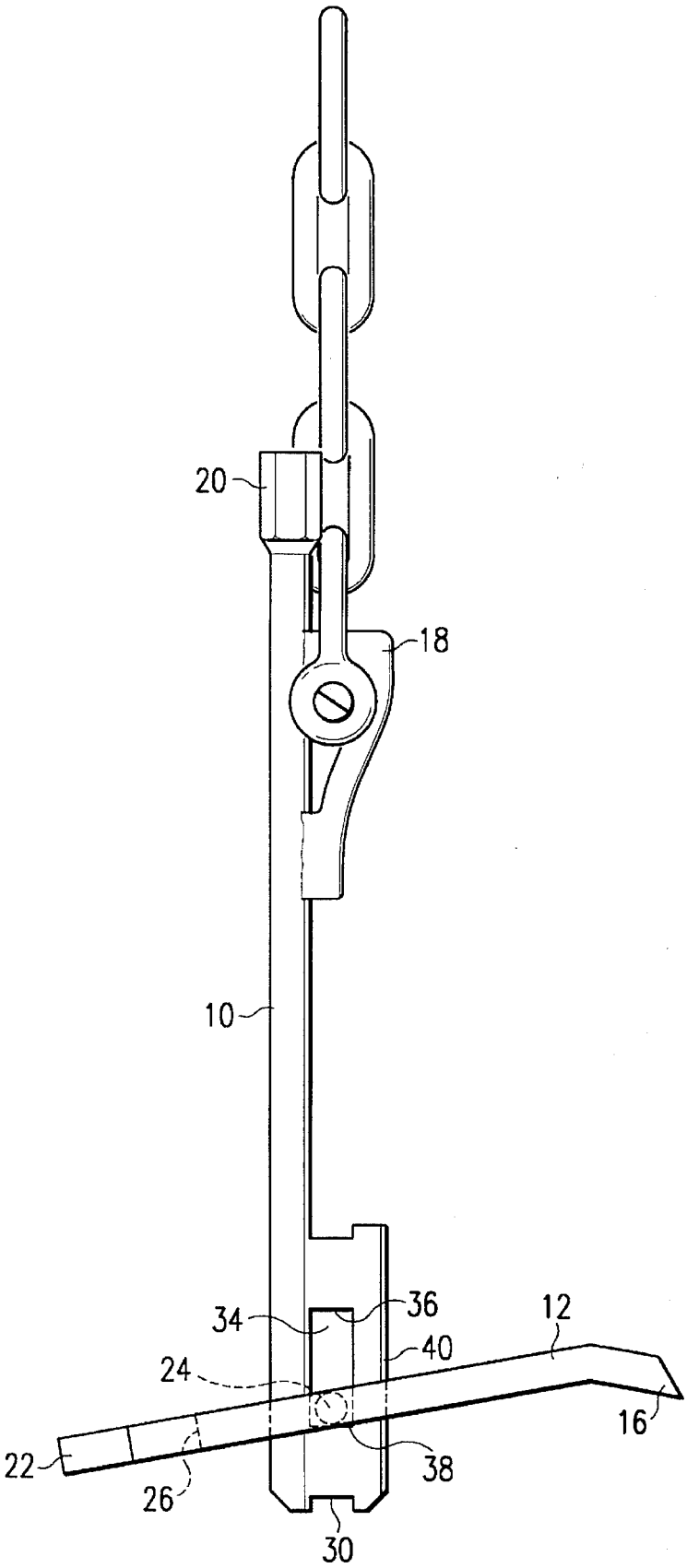
FIG. 4A illustrates a side view of a ground anchor according to the teachings of the present invention after the anchor is set.
Figure 5:
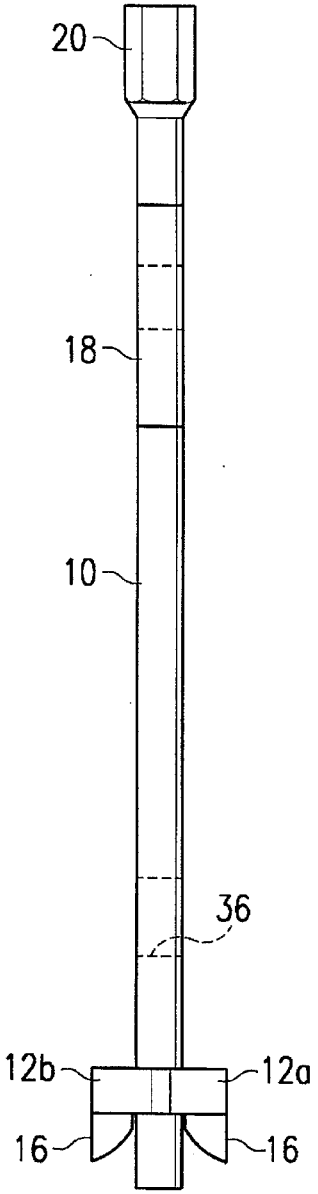
FIG. 5 illustrates a side view of a ground anchor according to the teachings of the present invention after the anchor is set.

FIGS. 2–6 illustrate particular views of a ground anchor according to the teachings of the present invention. FIGS. 2 and 3 illustrate the anchor before it has been set, while FIGS. 4A and 5 illustrate the anchor after it has been set. As shown in these FIGUREs, the anchor shank 10 includes a socket 20 for use in coupling an applicator (insertion device) to the anchor shank 10, for use in driving the ground anchor into the ground. Socket 20 may be any suitable fitting or socket, such as a threaded fitting for use with an applicator to be discussed below in connection with FIG. 7, or a socket for directly receiving a driving device, such as a jackhammer.

As shown in the FIGURES, anchor body 12 includes a leading end 22 which joins anchor body members **12*a* and 12*b*. Leading end 22 may be beveled, pointed, or angled to accommodate insertion into the ground. Anchor body 12 also includes a pivot pin 24 for providing the pivotal connection with anchor shank 10. Pivot pin 24 may be formed integrally with or separate from anchor body 12. Leading end 22 includes an anchor body shoulder 26. Shoulder 26 engages with a recessed driving shoulder 30 of anchor shank 10. The recessed driving shoulder 30 allows the anchor body 12 to "lock" into anchor shank 10 during insertion of the ground anchor into the ground, thereby avoiding premature pivoting of the anchor body 12 about anchor shank 10**.

The pivot pin 24 of anchor body 12 pivots within pivot pin slot 34 of anchor shank 10. This pivot pin slot 34 is defined by pivot pin upper and lower shoulders 36 and 38 and slot cap 40. Anchor shank 10 and slot cap 40 extend beyond recessed shoulder 30.

Because of the recessed driving shoulder 30 discussed above, the pivotal connection between the anchor shank 10 and anchor body 12 of the present invention provides an important technical advantage. In particular, during insertion or driving of the anchor into the ground, the anchor body 12 "locks" into anchor shank 10, thus avoiding premature setting of the anchor. However, it should be understood that this feature need not be included. Furthermore, other locking mechanisms could be used without departing from the intended scope herein.

Furthermore, other types of pivotal connections between the anchor shank 10 and anchor body 12 may be used without departing from the intended scope herein. For example, anchor shank 10 could be forked, with anchor body 12 pivoting between the forks of anchor shank 10.

Figure 4B:
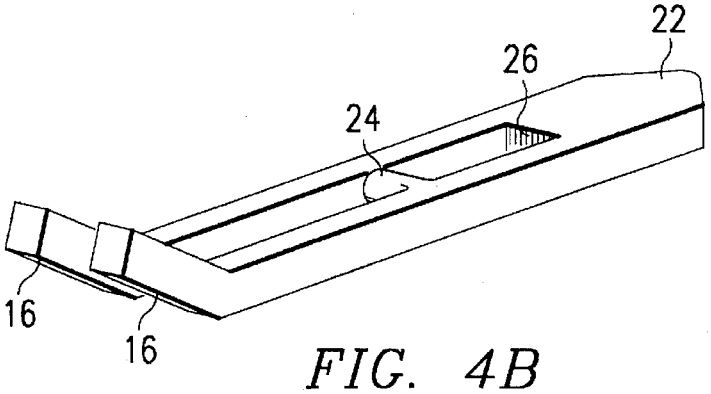
FIGS. 4B and 4C illustrate details of particular embodiments of an anchor body according to the teachings of the present invention.

As shown in FIGS. 4A and 4B, anchor body members **12*a* and 12*b* are angled at ends 16. As shown in FIG. 4A, these ends may be beveled, or, as shown in FIG. 4B, need not be beveled. By beveling the end 16, the ground anchor of the present invention can be more quickly set upon the pulling action. The anchor members 12*a* and 12*b* may also be joined at or near the end 16** to increase strength.

Figure 4C:
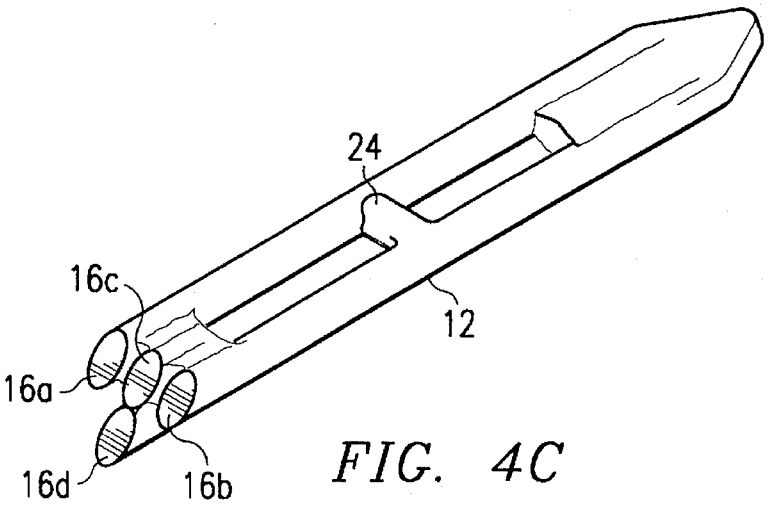
Figure 6:
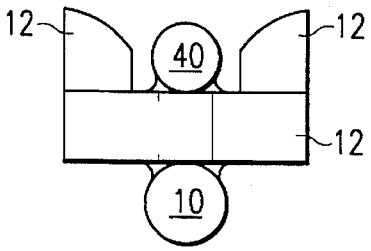
FIG. 6 illustrates a cross-sectional view of a ground anchor according to the teachings of the present invention.

FIG. 4C illustrates another alternative for anchor body end 16, in which several ends **16*a*–16*d* are presented to reduce overall insertion cross sectional area. Rather than angling the end 16, the thickness of end 16 is built up with end 16*d* to ensure engagement with the ground during anchor setting. The end 16 shown in FIG. 4C may also be beveled to improve ground-engagement. The members 16*a*–16*d* need not be separate, but can be formed as one end. Moreover, the shape or thickness of the end 16** may be varied to embodiments other than those shown in FIGS. 4A–4C.

Figure 7:
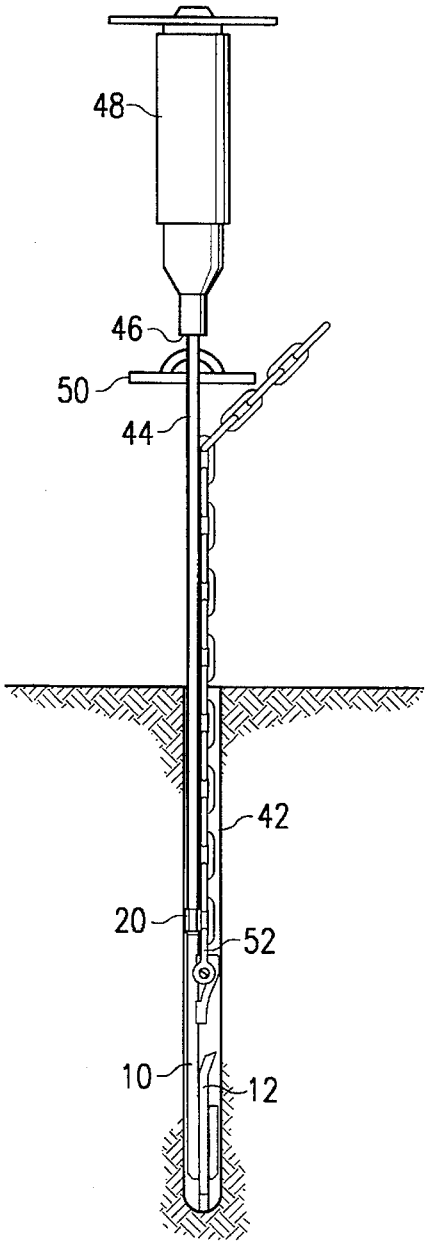
FIG. 7 illustrates insertion of a ground anchor according to tie teachings of the present invention.

FIG. 7 illustrates insertion of the ground anchor according to the teachings of the present invention. As shown in FIG. 7, a pre-drilled hole 42 is provided into which the ground anchor is inserted, although no pre-drilled hole is needed. An applicator tool 44 may be coupled to anchor shank 10, for example at socket 20. This applicator tool 44 includes a socket 46 for receiving a driving tool, such as a jackhammer 48. Applicator tool 44 also includes outwardly extending stop 50.

In operation, the hole 42 is drilled, and applicator tool 44 is coupled to anchor shank 10. Also, the connecting member for connecting the anchor to the structure to be anchored is coupled to the anchor shank 10. In a particular example, this connecting member may be a chain connected to padeye 18, with a shackle 52. The driving instrument, such as jackhammer 48, is coupled to the applicator tool and used to drive the anchor into the pre-drilled hole 42. Once the anchor is inserted to the desired depth, the applicator tool 44 is disengaged from anchor shank 10, such as by unscrewing it. The anchor is then set by pulling on the connecting member, such as the chain shown in FIG. 7. As discussed above, this pulling operation results in the end 16 of anchor body 12 engaging with the ground, thus resulting in the pivoting of anchor body 12 to a transverse position (as shown in FIGS. 4A and 5).

The use of applicator tool 44 allows for the ground anchor to be inserted to a greater depth than if the drive instrument were coupled directly to the ground anchor. However, it should be understood that the applicator tool is not necessary, and the drive instrument can be coupled directly to the anchor shank 10. Furthermore, as discussed above, applicator tool 44 may include a stop 50. The stop 50 extends out from the applicator tool and should be of a size that is wider than the diameter of the hole 42. This stop operates to stop insertion of the ground anchor once the stop reaches the ground. In this way, the desired depth of the anchor can be insured.

Figure 8:
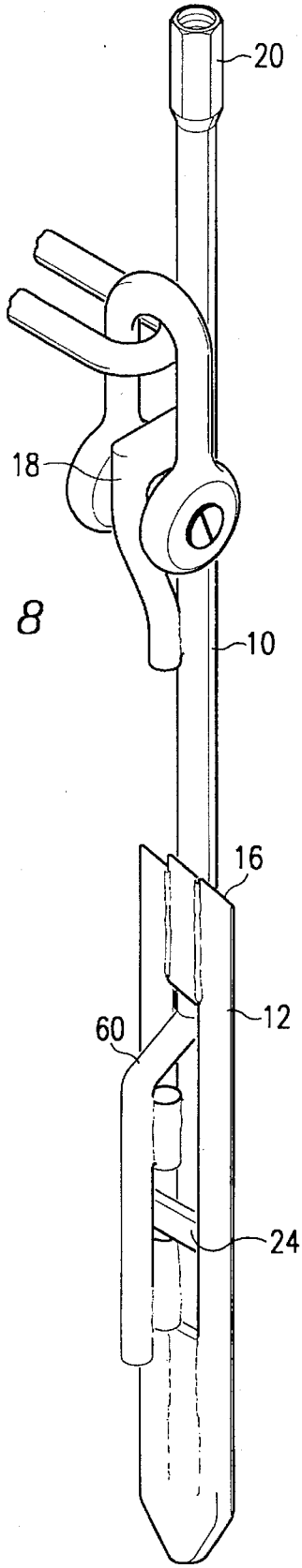
FIG. 8 illustrates a perspective view of another embodiment of a ground anchor according to the teachings of the present invention.

FIG. 8 illustrates a perspective view of an alternative embodiment of the present invention, in which an angled shoulder 60 is provided on anchor shank 10. With this embodiment, members 12*a* and 12*b* are joined at end 16. Angled shoulder 60 facilitates pivoting of anchor body 12 because it is angled in the direction end 16 pivots. In particular, when the end 16 engages with the ground during setting of the anchor, the angled shoulder 60 contacts the inside shoulder of end 16 and directs anchor body 12 in the pivoting direction.

Figure 9:
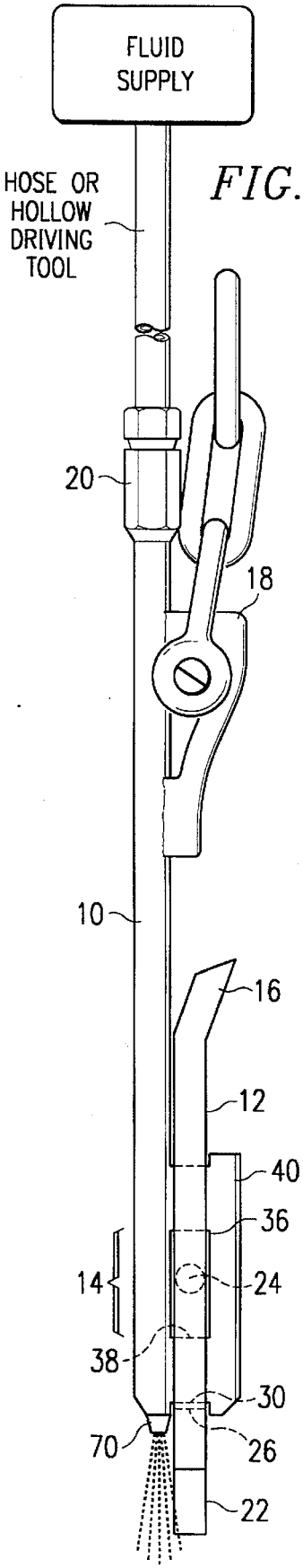
FIGS. 9 –10 illustrate embodiments allowing for jetting operations according to the present invention.
Figure 10:
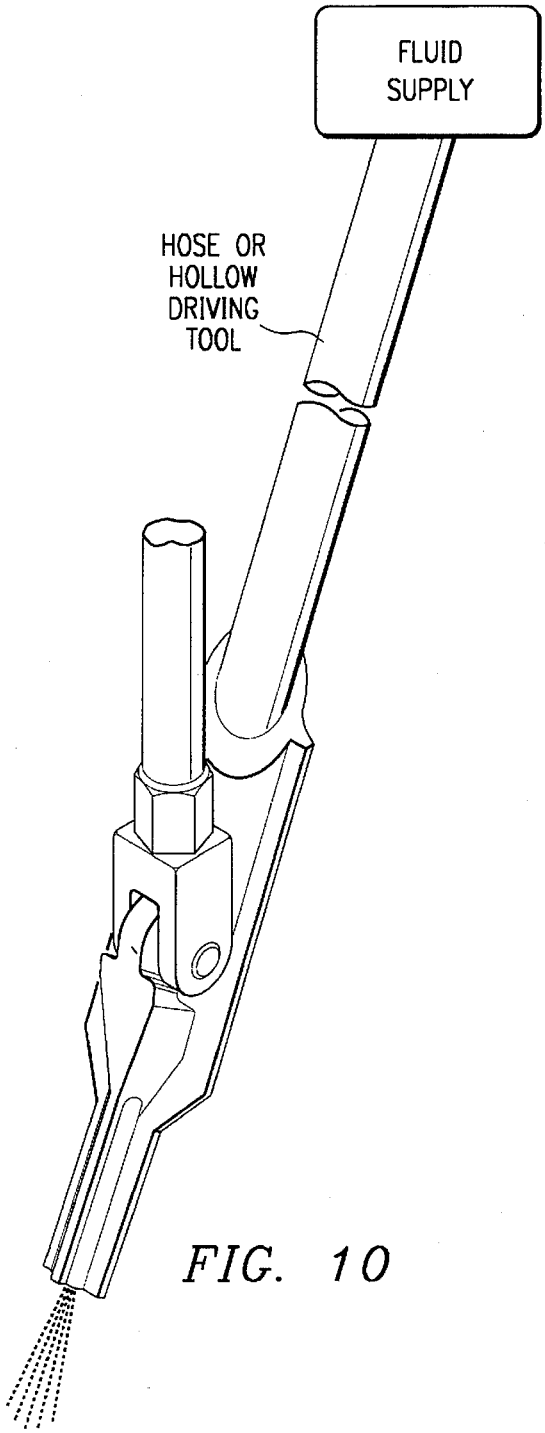

In another embodiment, shown in FIG. 9, anchor shank 10 is hollow, and includes an open end 70 (or nozzle), to facilitate jetting operations. By "hollow" it is meant that the piece has a channel or other void allowing for the flow of a fluid. A supply of water or air (or other fluid) is coupled to socket 20 to supply a fluid through the anchor shank 10 and end 70. This fluid supply can be supplied through a hose or hollow driving tool, or other possible supply couplings. This process assists in clearing a passage through the ground for insertion of the anchor. This jetting capability simplifies anchor insertion in many soil conditions that have previously presented significant difficulties, such as sand, clay, and mud. Indeed, the jetting advantage can be implemented without an anchor shank, for example with certain prior art anchor systems. To take advantage of the present invention's jetting capability to improve prior art anchors, the prior art anchor pieces can be hollowed and adapted to couple with a water or air supply, as shown in FIG. 10. For example, a driving tool used to drive the anchor of FIG. 10 can be hollowed to allow a fluid to pass through the driving tool and hollowed anchor piece. Alternatively, the fluid supply can be coupled directly to the hollow anchor piece, for example with a hose, and the anchor can then be driven with the connecting member.

The ability to supply fluids for jetting operations avoids the need in many cases for machinery needed for driving, such as hydraulic or pneumatic hammers, and the associated hydraulic or pneumatic systems.

In summary, a ground anchor is provided which an anchor shank includes a connection point for attachment of connecting member, the connection point being remote from a pivot point of an anchor body. By making the connection point remote from the pivot point, the anchor of the present invention has a smaller cross section than anchors of comparable strength. Furthermore, the present invention provides for a locking mechanism between the anchor body and anchor shank, thus avoiding premature setting of the anchor during insertion of the anchor into the ground. Furthermore, an applicator tool is provided for allowing the anchor of the present invention to be inserted a desired distance into the ground. Also provided is a hollow embodiment to facilitate jetting operations.

The particular shape of various members of the present invention may be changed without departing from the intended scope. For example, shank 10 and other members may have a round, square, polygon, elliptical, or other shaped cross section.

Although the present invention has been described in detail, it should be understood that various modifications, substitutions, or alterations can be made without departing from the intended scope as defined by the appended claims.

What is claimed is:

1. An anchor for anchoring a structure to the ground, the anchor operable to couple to the structure through a connecting member, the anchor comprising:

an anchor shank having:

a first end and a second end, the first end providing a driving surface for the anchor;

a connection feature positioned proximate the first end, remote from the driving surface and offset from a central axis of the anchor shank, the connection feature for coupling the connecting member to the anchor shank;

a pivot slot positioned proximate the second end and offset from the central axis of the anchor shank in the same direction as the connection feature, such that the pivot slot is substantially in-line with the connection feature; and an anchor body pivotally connected to the anchor shank at the pivot slot, the anchor body having:

a first end and a second end, the anchor body connected to the pivot slot intermediate the first end and the second end of the anchor body; and the first end of the anchor body formed with an angled portion that extends away from the central axis of the anchor shank in the same direction as the offset of the connection feature, the angled portion for engaging with the ground when the anchor is set;

the anchor having a pre-set state in which the anchor body is pivoted in the pivot slot to be parallel with the anchor shank with the first end of the anchor body extending towards the first end of the anchor shank and to be substantially in-line with the connection feature and the pivot slot; and the anchor having a set state in which the anchor body is pivoted in the pivot slot to no longer be parallel with the anchor shank.

2. The anchor of claim 1, wherein the driving surface of the anchor shank incudes a socket to facilitate insertion of the anchor into the ground.

3. The anchor of claim 1, wherein the second end of the anchor shank includes a recessed shoulder for engaging with the anchor body.

4. The anchor of claim 1, wherein the first end of the anchor shank is hollow and includes an open end.

5. The anchor of claim 1, wherein the second end of the anchor body includes a beveled leading edge.

6. The anchor of claim 1, wherein the angled portion of the first end of the anchor body has a forked shape with prongs angled away from each other as well as being angled away from the central axis.

7. The anchor of claim 6, wherein the angled portion is beveled.

8. The anchor of claim 1, and further comprising an applicator tool coupled to the anchor shank at the driving surface, the applicator tool extending from the anchor shank and allowing insertion of the anchor into the ground to a predetermined depth.

9. The anchor of claim 8, wherein the applicator tool includes a stop for stopping insertion of the anchor at the predetermined depth.

10. An anchor for anchoring a structure to the ground, the anchor operable to couple to the structure through a connecting member, the anchor comprising:

an anchor shank having:

a first end and a second end, the first end providing a driving surface for the anchor;

a connection feature for receiving the connecting member, the connection feature proximate the first end and remote from the driving surface of the anchor shank; and a pivot slot positioned proximate the second end and remotely disposed from the connection feature; and an angled shoulder positioned between the connection feature and the pivot slot, the angled shoulder extending away from a center axis of the anchor shank and extending towards the second end of the anchor shank to form an acute angle; and an anchor body pivotally connected to the anchor shank at the pivot slot, the anchor body having:

a first end and a second end, the anchor body connected to the pivot slot intermediate the first end and the second end of the anchor body; and a cross-portion extending across the first end of the anchor body;

the anchor having a pre-set state in which the anchor body is pivoted in the pivot slot to be parallel with the anchor shank with the first end of the anchor body extending towards the first end of the anchor shank and with the cross-portion of the anchor body positioned proximate the angled shoulder of the anchor shank;

the anchor having a set state in which the anchor body is pivoted in the pivot slot to no longer be parallel with the anchor shank; and the angled shoulder of the anchor shank contacting the cross-portion of the anchor body when the anchor is set such that the angled shoulder directs the anchor body in the pivoting direction.

11. The anchor of claim 10 wherein the driving surface of the anchor shank includes a socket to facilitate insertion of the anchor into the ground.

12. The anchor of claim 10, wherein the second end of the anchor shank includes a recessed shoulder for engaging with the anchor body.

13. The anchor of claim 10, wherein the first end of the anchor shank is hollow and includes an open end.

14. The anchor of claim 10, and further comprising an applicator tool coupled to the anchor shank at the driving surface, the applicator tool extending from the anchor shank and allowing insertion of the anchor into the ground to a predetermined depth.

15. The anchor of claim 14, wherein the applicator tool includes a stop for stopping insertion of the anchor at the predetermined depth.

* * * * *